United States Patent [19]

Horn et al.

[11] Patent Number: 4,534,176

[45] Date of Patent: Aug. 13, 1985

[54] LINEAR RESONANCE CRYOGENIC COOLER

[75] Inventors: Stuart B. Horn; Richard A. Wright, both of Fairfax; Howard L. Dunmire, Stafford, all of Va.

[73] Assignee: The United States of America as represented by the Secretary of the Army, Washington, D.C.

[21] Appl. No.: 593,948

[22] Filed: Mar. 23, 1984

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,991,586 | 11/1976 | Acord | 62/6 |
| 4,090,858 | 5/1978 | Hanson | 62/6 |
| 4,397,155 | 8/1983 | Davey | 62/6 |
| 4,403,478 | 9/1983 | Robbins | 62/6 |
| 4,417,448 | 11/1983 | Horn et al. | 62/6 |

*Primary Examiner*—William E. Wayner

*Attorney, Agent, or Firm*—Anthony T. Lane; Milton W. Lee; Max L. Harwell

[57] ABSTRACT

The disclosure is a dual controlled linear resonance cryogenic cooler and is comprised of a remote cold finger and a compressor, both driven by linear motors. A motor control means is used with the linear motors to drive both motors with a phase delay of the cold finger motor from that of the compressor motor such that the compressor linear motor alternately drives a piston to produce alternating pressure waves in a light cooling gas in working relation with a regenerator-displacer in the remote cold finger and the cold finger linear motor has a delayed phase relationship with the compressor linear motor. The use of linear motors which are slightly out of phase with each other selectively provides flat top and bottom dead center with constant linear increases and decreases therebetween for the compressor piston to follow and to eliminate the normal side forces of the piston that cause excessive wear.

4 Claims, 3 Drawing Figures

LINEAR RESONANCE CRYOGENIC COOLER

The invention described herein may be manufactured, used, and licensed by the U.S. Government for governmental purposes without the payment of any royalties thereon.

BACKGROUND OF THE INVENTION

1. Field of the Invention

The invention relates to means for producing optimized cooler waveforms to improve the coefficient of performance of cryogenic coolers, and especially to using linear motor drive means for producing both the compression waves in the working gas and regenerator-displacer movement in proper wave shapes and phased relationship.

2. Description of the Prior Art

Cryogenic coolers that operate at liquid nitrogen temperatures suffer from poor reliability. Most of the reliability problems are the result of working fluid gas contamination and of wearout of the moving parts. Linearly driven compressor pistons and regenerator-displacers can help solve the poor reliability problem, while providing improvements in performance at reduced fabrication costs.

SUMMARY OF THE INVENTION

The present invention relates to linear motor drive means for producing optimized waveforms in a closed cycle cryogenic cooler in which the cooler is remote to a compressor. The compressor piston and the cooler regenerator-displacer are driven by separate linear motors. The motors are resonant with each other to provide maximum coefficient of performance in which the compressor waves are produced about 90° ahead of the cooler. The compressor provides pressure waves by way of a cooling gas feed line to the regenerator-displacer of a cold finger of the cooler. The displacer waves are produced in like motion but with a delay of about 90°.

The compressor is activated by a motor control means switching in the compressor linear motor wherein the compressor piston is attached to the motor. The compressor is operated near its resonant frequency. The following advantages are realized. Clearance seals may be used instead of friction seals because of the elimination of side forces. Elements that are eliminated include the ball bearings, the flywheel, the connecting rod, the crankshaft and any lubrication. The size and weight are greatly reduced and the acoustic noise generation is suppressed because of the reduction of metal to metal contact. Reliability is increased due to the elimination of the lubricants and bearings. It should be noted that lubricants are a main source of gaseous and particulate contamination. The coefficient of performance is improved because the compressor linear motor can produce a selected optimum waveform for the compressor piston to follow.

The remote cold finger portion of the cooler is the cooling surface. The displacer in the cold finger is operated by a cooler linear motor. Advantages of the cooler portion are as follows. The reliability of the cold finger is greatly enhanced because the cooler linear motor does not have radial forces that causes wearout. An improvement in the coefficient of performance is realized because the cooler linear motor can generate an optimum waveform for the displacer to follow.

A motor control means is used to establish the proper waveshapes and phasing somewhere about the 90° advance for the compressor linear motor ahead of the cooler linear motor. This fine tuned phasing is performed while monitoring the actual cooling of the cold finger. The motor control means is set to phase the motors accordingly.

DETAILED DESCRIPTION OF THE PREFERRED EMBODIMENT

Figure 1:
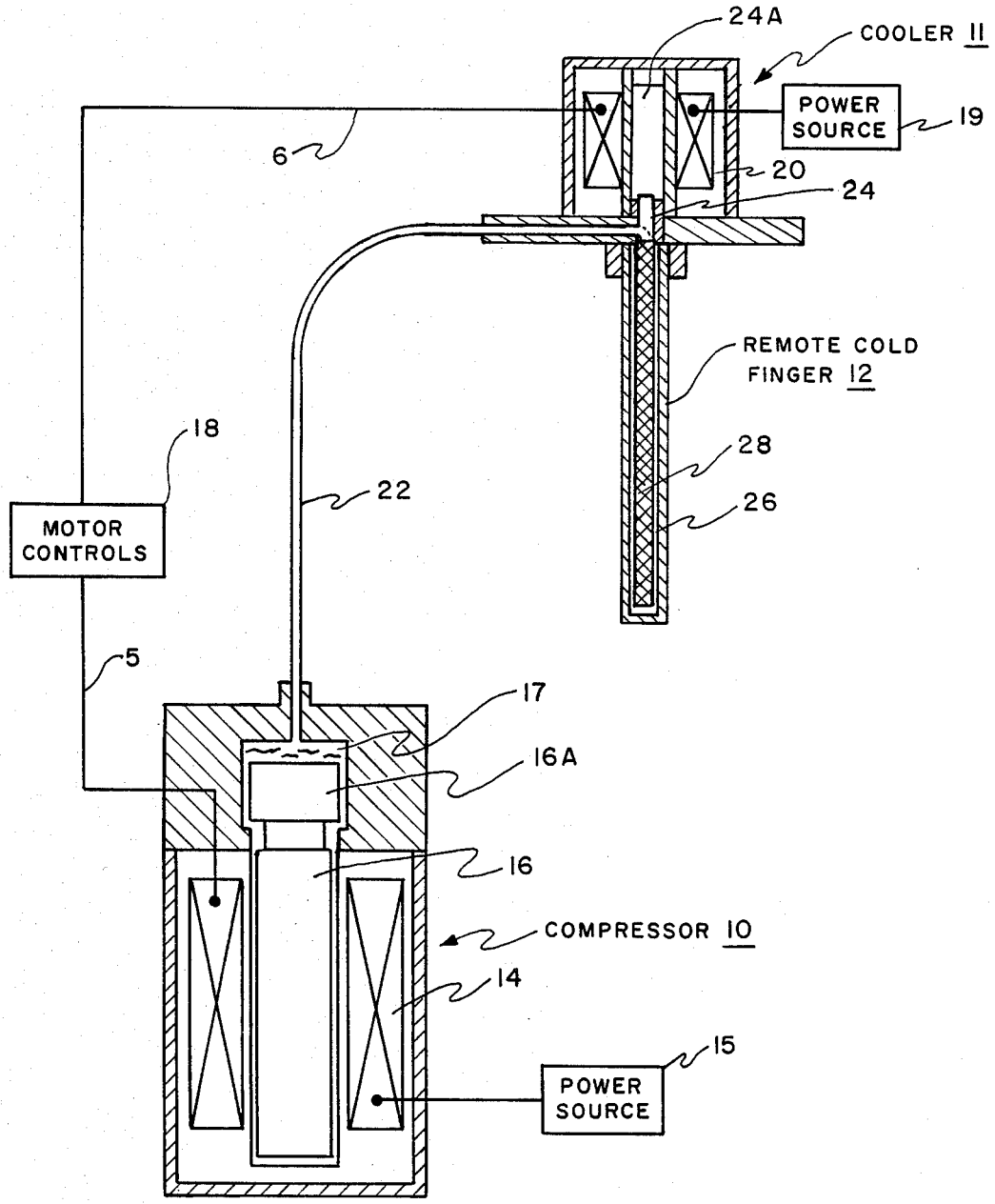
FIG. 1 illustrates a cutaway view of present linear resonance cryogenic coolers.
Figure 2A:
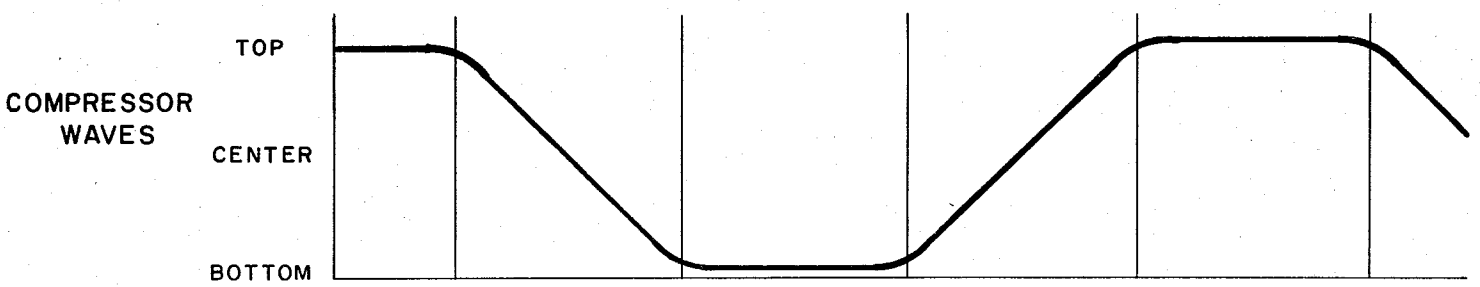
FIGS. 2A and 2B illustrate the relative phasing of the compressor piston and the regenerator-displacer that provides high efficiency operation.
Figure 2B:
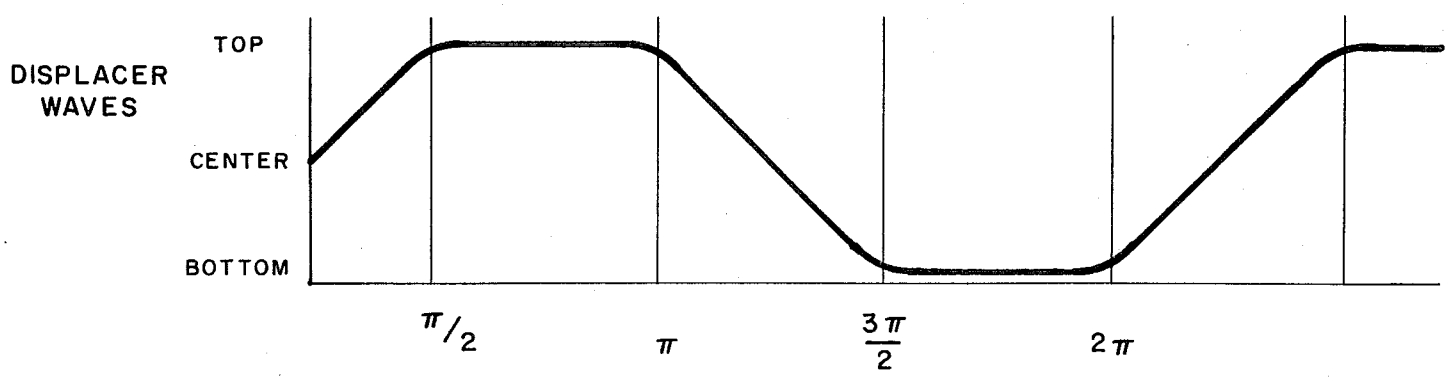

Refer now to FIGS. 1, 2A, and 2B for an explanation of a typical split Stirling cycle closed cycle cryogenic cooler which is operated on by resonant linear motors to provide improved efficiency and to eliminate many moving parts and excessive lateral motion. FIGS. 2A and 2B respectively illustrate each of the typical compressor piston and displacer waveforms that provide the maximum efficiency. The compressor piston 16, which is attached to compressor linear drive motor 14, is phased about 90° ahead of the movement of displacer 26, which is in reality an extension of shaft 24 and shaft magnetic material 24A that is in turn attached to cooler linear drive motor 20. Displacer 26 has a regenerator matrix 28 therein which provide cooling for the remote cold finger 12. Each of the linear motors 14 and 20 have separate power sources 15 and 19 respectively. These power sources are preferably DC voltage supplies that are converted to the AC voltage which drives the motors. The DC voltages may be on the order of about 15 to 18 volts. The linear resonant cryogenic cooler as depicted by FIG. 1 may be a $\frac{1}{4}$ watt linear cooler. The compressor 10 and cooler 11 therefore have a linear motor driven piston and regenerator-displacer in a selected waveform and phasing that is controlled by a motor control means 18.

The light cooling gas occupies the closed space comprised of the compressor volume 17, the gas feed line 22, and the volume within cold finger 12. The light cooling gas may be hydrogen or helium. The clearance between piston head 16A and the piston wall forms a clearance seal. The clearance is preferably about 0.001 inch.

The motor control means 18 preferably is a waveform generator means, such as function generators or logic circuit means, wherein the most efficient waveforms may be first obtained in a laboratory test environment. The invention is not however limited to maximum efficiency waveform tests in a laboratory setting. Rather, after the maximum efficiency waveforms are determined a convenient waveform generator, or one waveform generator per motor, may be used in conjunction with linear motors 14 aand 20 to continue the maximum efficiency waveforms for the remaining life of the linear resonant cryogenic cooler.

If the waves are formed by the use of a function generator, the waveforms may be extended or decreased at the top and bottom and the linear transitions therebetween may be accelerated or decelerated as to establish and maintain maximum cooling. The function generator may simply be plugged into the wall 60 cycle 110 volt power supply which already has the alternating voltage therein. Conversely, if a logic circuit is used to form the waves the internal direct source is accompanied by an oscillator for converting over to the proper alternating voltage to trigger the linear motors into operation. As stated above, compressor linear motor operates compressor 10 at near its resonance frequency for enhanced efficiency. Cooler linear motor 20 is phase delayed by about 90° to drive the regenerator-displacer in synchronous operation with the pressure waves impacted to the working fluid but about 90° phase delayed.

While many modifications may be obvious to one skilled in the art of the present invention, it is to be understood that I desire to be limited in the spirit of our invention only by the scope of the amended claims.

We claim:

1. A linear resonance cryogenic cooler means for producing optimized cooler expander waveforms in a closed cycle system cooler having reciprocating displacer-expander cooling, said means comprising:

a linear motor drive means comprised of a compressor linear drive motor and a cooler linear drive motor for driving a compressor near its resonance frequency for producing alternating pressure waves in a light cooling gas enclosed within said closed cycle system cooler and for simultaneously driving the displacer of a regenerator-displacer in a cold finger of said cooler in reciprocal motion wherein the reciprocal motion of said displacer is phase delayed from said alternating pressure waves by about 90° through repetitive cycles in which both compressor alternating pressure waves and the displacer reciprocal motion waves have essentially the same wave shape wherein said compressor linear drive motor has a compressor piston attached thereto in which the piston head is in direct contact with said gas and said cooler linear drive motor has a shaft attached thereto which is hard connected to said displacer; and a waveform generator control means for selectively controlling said linear motor drive means to provide optimum wave shapes for optimum cooling wherein said compressor linear drive motor and said cooler linear drive motor respectively produce said alternating pressure waves and displacer reciprocal motion waves which have four relatively equal portions during about 90° of each repetitive cycle which is defined as a top dead center, a linear acceleration, a bottom dead center, and a linear acceleration back to the top dead center wherein said waveform generator control means varies the time of said four relatively equal portions and to control the acceleration rate to provide optimum cooling.

2. A cooler means as set forth in claim 1 wherein said waveform generator control means is a separate waveform generator connected to each of said compressor linear drive motor and said cooler linear drive motor.

3. A cooler means as set forth in claim 1 wherein said waveform generator control means is a function generator producing waveforms that drive said linear motors which extend or decrease said top and bottom dead centers and control the acceleration rate of the linear transitions therebetween to establish maximum cooling.

4. A cooler means as set forth in claim 1 wherein said waveform generator control means is a logic circuit which may have the optimum waveforms programmed into its memory wherein said optimum waveforms drive said linear motors.

* * * * *